US008078074B2

(12) United States Patent
Fukui

(10) Patent No.: US 8,078,074 B2
(45) Date of Patent: Dec. 13, 2011

(54) IMAGE FORMING APPARATUS AND IMAGE FORMING METHOD

(75) Inventor: Takashi Fukui, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 586 days.

(21) Appl. No.: 12/236,887

(22) Filed: Sep. 24, 2008

(65) Prior Publication Data

US 2009/0080927 A1 Mar. 26, 2009

(30) Foreign Application Priority Data

Sep. 25, 2007 (JP) ..... 2007-247971

(51) Int. Cl.
*G03G 15/20* (2006.01)

(52) U.S. Cl. ..... 399/69

(58) Field of Classification Search ..... None
See application file for complete search history.

(56) References Cited

U.S. PATENT DOCUMENTS 5,666,623 A * 9/1997 Yamada et al. ..... 399/320
7,273,272 B2 * 9/2007 Inoue ..... 347/85
7,274,514 B2 * 9/2007 Uematsu ..... 359/654
2004/0126153 A1 7/2004 Koga et al.
2005/0206696 A1 9/2005 Inoue
2006/0203079 A1 * 9/2006 Sakai et al. ..... 347/243
2007/0036571 A1 * 2/2007 Kagawa et al. ..... 399/69
2007/0206980 A1 * 9/2007 Frohlich ..... 399/322

FOREIGN PATENT DOCUMENTS

CN 1497389 A 5/2004
JP 7-148917 A 6/1995

* cited by examiner

*Primary Examiner* — Stephen Meier
*Assistant Examiner* — Alexander C Witkowski
(74) *Attorney, Agent, or Firm* — Birch, Stewart, Kolasch & Birch, LLP.

(57) ABSTRACT

An image forming apparatus has: an intermediate transfer body which carries an image; a transfer mechanism which transfers the image carried on the intermediate transfer body, onto a transfer surface of a recording medium fixed to a surface of a rotating body; and a fixing mechanism which is disposed so as to oppose the surface of the rotating body to a downstream side of the transfer mechanism in terms of a direction of rotation of the rotating body, and which fixes the image that has been transferred to the transfer surface of the recording medium, onto the recording medium.

13 Claims, 16 Drawing Sheets

FIG.10

| | SYMBOL | CONDITION |
|---|---|---|
| SURFACE TEMPERATURE OF ROTATING DRUM | T1 | 90℃ |
| SURFACE TEMPERATURE OF TRANSFER ROLLER | T2 | 70℃ |
| TEMPERATURE OF HEATING ROLLER | T3 | 140℃ |
| TEMPERATURE OF HALOGEN HEATER | T4 | 140℃ |
| TEMPERATURE OF FIXING ROLLER | T5 | 140℃ |
| PRESSURE OF HEATING ROLLER | P1 | 100kPa |
| PRESSURE OF FIXING ROLLER | P2 | 2MPa |

IMAGE FORMING APPARATUS AND IMAGE FORMING METHOD

BACKGROUND OF THE INVENTION

1. Field of the Invention

The present invention relates to an image forming apparatus and image forming method, and more particularly, to an image forming apparatus and image forming method whereby an image can be transferred and fixed onto a recording medium that has a large size and small thickness and is carried at high speed.

2. Description of the Related Art

Japanese Patent Application Publication No. 7-148917 discloses transferring an image formed on a transfer drum by an inkjet recording head, onto a recording medium by means of a transfer device, and then carrying out a fixing process by means of a fixing device.

However, in Japanese Patent Application Publication No. 7-148917, a transfer device and a fixing device are independently provided side by side following the direction of conveyance of the recording medium. The recording medium is conveyed in a horizontal state from the transfer device to the fixing device. Therefore, it is difficult or not possible to transfer or fix the image onto a recording medium of large size and small thickness while conveying the recording medium at high speed. Furthermore, since the transfer device and the fixing device are independently provided side by side following the direction of conveyance of the recording medium, the apparatus becomes large in size.

SUMMARY OF THE INVENTION

The present invention has been contrived in view of the foregoing circumstances, an object thereof being to provide an image forming apparatus and an image forming method whereby an image can be transferred and fixed onto a recording medium of large size and small thickness that is conveyed at high speed, while achieving a compact size of the apparatus.

In order to attain an object described above, one aspect of the present invention is directed to an image forming apparatus, comprising: an intermediate transfer body which carries an image; a transfer mechanism which transfers the image carried on the intermediate transfer body, onto a transfer surface of a recording medium fixed to a surface of a rotating body; and a fixing mechanism which is disposed so as to oppose the surface of the rotating body to a downstream side of the transfer mechanism in terms of a direction of rotation of the rotating body, and which fixes the image that has been transferred to the transfer surface of the recording medium, onto the recording medium.

In this aspect of the invention, since the transfer mechanism and the fixing mechanism are disposed so as to oppose the surface of the rotating body and the recording medium is conveyed from the transfer device to the fixing device in a state where it is fixed to the surface of the rotating body, then it is possible to transfer and fix an image while conveying a recording medium of large size and small thickness at high speed. Furthermore, it is also possible to make the image forming apparatus more compact in size.

Desirably, the fixing mechanism has: a heating device which heats the transfer surface of the recording medium onto which the image has been transferred; a heat maintaining device which maintains a heat of the transfer surface of the recording medium which has been heated by the heating device; and a fixing device which is disposed to a downstream side of the heating device in terms of the direction of rotation of the rotating body, and which fixes the image that has been transferred to the transfer surface of the recording medium.

In this aspect of the invention, since the heating device, the heat maintaining device and the fixing device are provided as the fixing mechanism, then it is possible to fix the image reliably onto the recording medium, while suppressing decline in the surface temperature of the recording medium during the fixing process.

Desirably, the image forming apparatus further comprises a temperature control mechanism which is disposed to an upstream side of the transfer mechanism in terms of the direction of rotation of the rotating body, and which controls a temperature of the recording medium.

In this aspect of the invention, it is possible to improve the quality of the transferred image by controlling the temperature of the recording medium by means of the temperature control mechanism.

Desirably, the transfer mechanism has a pressurization roller which is disposed so as to oppose the surface of the rotating body, and which is set to a lower temperature than a surface temperature of the rotating body.

In this aspect of the invention, it is possible to improve the quality of the transferred image by suppressing shrinkage of the image during transfer. Furthermore, it is also possible to fix the image onto the recording medium in the fixing mechanism, in a short period of time.

Desirably, the image forming apparatus further comprises: a liquid deposition device which deposits ink and treatment liquid to form the image carried on the intermediate transfer body; and a control device which controls an interface temperature which is a temperature of a portion where the recording medium and the intermediate transfer body make mutual contact during transfer in the transfer mechanism, according to viscoelasticity characteristics of a latex contained in the ink and the treatment liquid which are deposited onto the intermediate transfer body by the liquid deposition device.

In this aspect of the invention, it is possible to control the interface temperature which is the temperature of the portion where the recording medium and the intermediate transfer body make mutual contact during transfer, and therefore the image transfer rate is improved.

Desirably, the fixing device has a pressurization roller which is set to a higher temperature than a surface temperature of the rotating body.

In this aspect of the invention, it is possible to fix the image reliably onto the recording medium by means of the pressurization roller which is set to a higher temperature than the surface temperature of the rotating body.

Desirably, the heating device has a pressurization roller which is set to a higher temperature than the surface temperature of the rotating body, and which applies a lower pressure to the recording medium than the fixing device.

In this aspect of the invention, it is possible to fix the image reliably onto the recording medium.

Desirably, the heat maintaining device is a radiant heating device.

Desirably, the heat maintaining device has an endless belt which is wrapped about the heating device and the fixing device, and which slides over the surface of the rotating body while being conveyed.

Desirably, the heat maintaining device has a heating member which contacts with a surface of the endless belt on an opposite side to a surface of the endless belt which slides over the surface of the rotating body.

Desirably, the temperature control mechanism controls a surface temperature of the rotating body.

In this aspect of the invention, it is possible to simplify the control device for controlling the surface temperature of the rotating body, as well as being able to reduce power consumption and make the image forming apparatus more compact in size.

Desirably, the temperature control mechanism has a pressurization roller which is set to a higher temperature than a surface temperature of the rotating body.

In this aspect of the invention, it is possible to improve the quality of the transferred image.

In order to attain an object described above, another aspect of the present invention is also directed to an image forming method, comprising: a transfer step of transferring an image carried on an intermediate transfer body, to a recording medium fixed to a surface of a rotating body; and a fixing step of fixing the image transferred to the recording medium in the transfer step, in a state where the recording medium is fixed to the surface of the rotating body.

According to the invention, it is possible to transfer and fix an image while conveying a recording medium of large size and small thickness at high speed.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 10 is a diagram showing the optimal temperature condition of each point

DETAILED DESCRIPTION OF THE PREFERRED EMBODIMENTS

Figure 1:
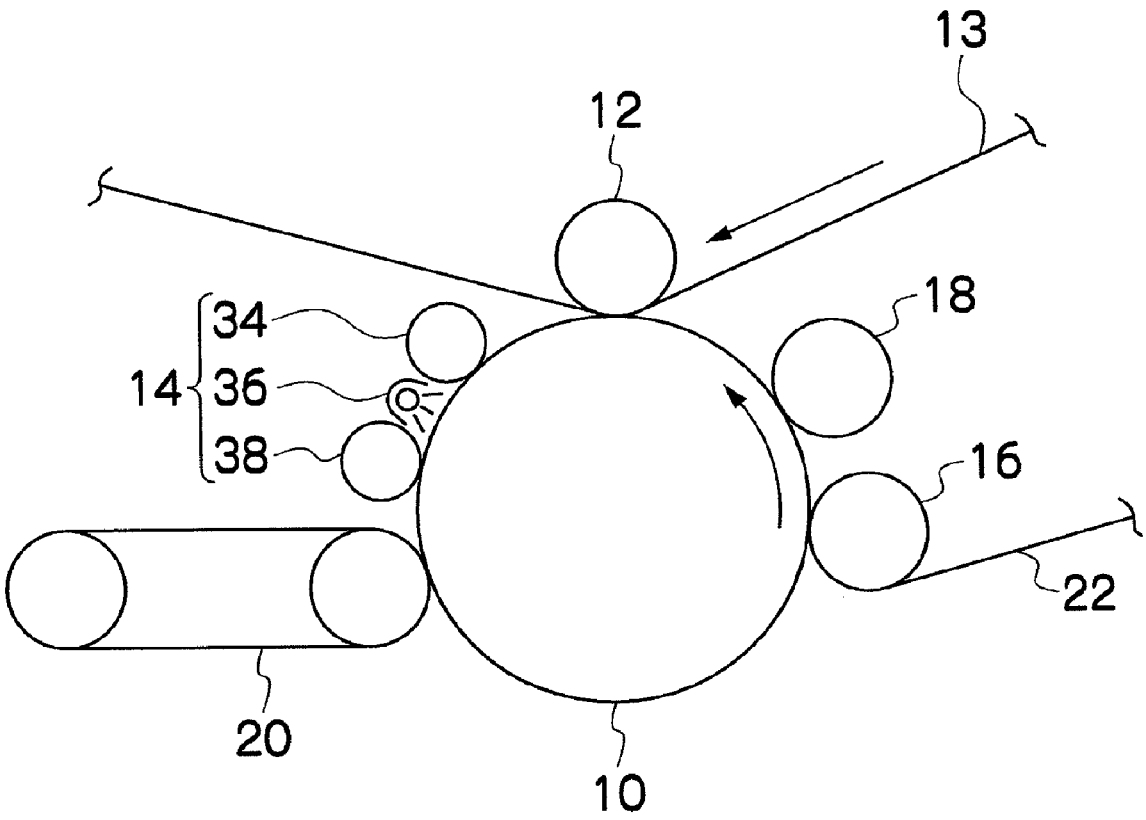
FIG. 1 is a diagram showing the composition of a transfer mechanism, a fixing mechanism and the periphery of same of an embodiment of the present invention.

Composition and Action of the Transfer Mechanism, Fixing Mechanism and Periphery of Same FIG. 1 is a diagram showing the composition of a transfer mechanism and a fixing mechanism of an embodiment of the present invention, and the periphery of same. As shown in FIG. 1, the composition of the transfer mechanism, the fixing mechanism and the periphery thereof includes: a transfer drum (rotating body) 10, a transfer roller 12 (transfer mechanism), an intermediate transfer body 13, a fixing mechanism 14, a recording paper supply roller 16, a temperature control roller 18 (temperature control mechanism), a chain conveyor 20, and the like.

The recording paper supply roller 16, the temperature control roller 18, the transfer roller 12, the fixing mechanism 14, and the chain conveyor 20 are provided in this order, from the upstream side to the downstream side in terms of the direction of rotation of the rotating drum 10, in a state of opposing the surface (outer circumference) of the rotating drum 10. The intermediate transfer body 13 and the recording paper 22 are sandwiched between the rotating drum 10 and the transfer roller 12. The transfer roller 12 provides a heating function, in addition to a pressurizing function.

Since the transfer roller 12 and the fixing mechanism 14 are disposed in a state of opposing the front surface of the rotating drum 10 in this way and the recording paper 22 is conveyed in a state where it is fixed to the front surface of the rotating drum 10, from the transfer roller 12 to the fixing mechanism 14, then it is possible to transfer and fix the image onto a recording paper 22 having a large size and a small thickness while conveying the recording paper 22 at high speed. Furthermore, it is also possible to reduce the size of the image forming apparatus which comprises the transfer mechanism, the fixing mechanism and the peripheral composition of same according to this embodiment of the present invention.

Figure 2:
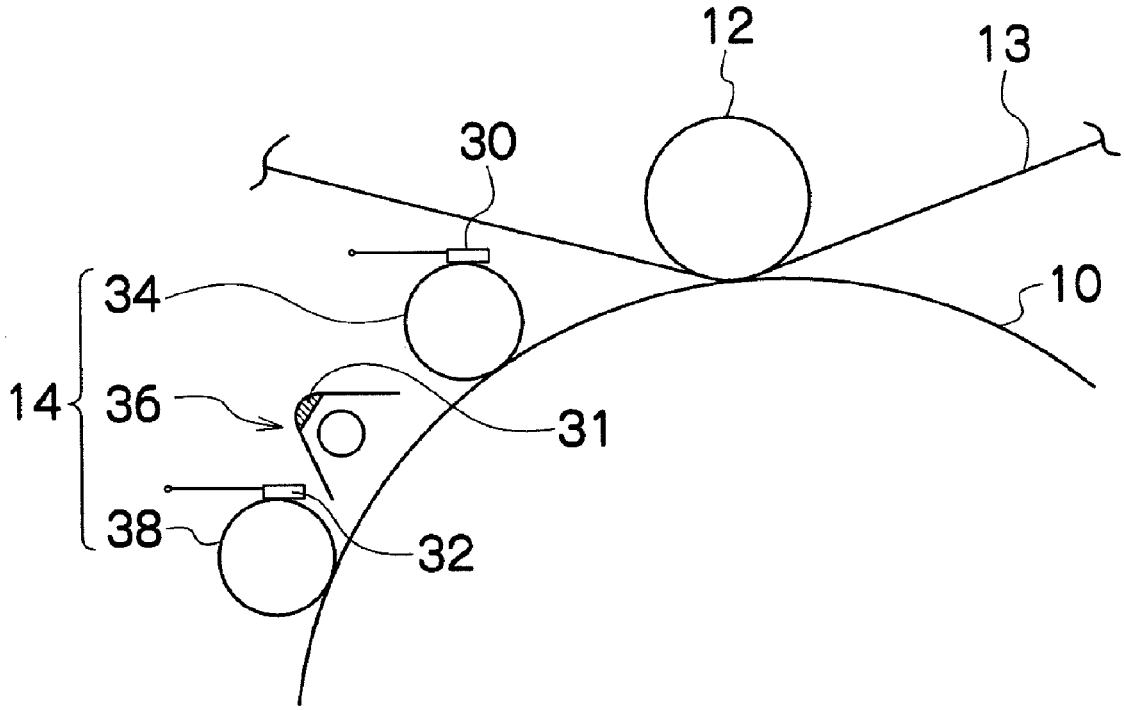
FIG. 2 is an enlarged diagram of the transfer mechanism and the fixing mechanism according to an embodiment of the present invention.

FIG. 2 is an enlarged diagram of the transfer mechanism and the fixing mechanism according to an embodiment of the present invention. As shown in FIG. 2, more precisely, a heating roller 34 (heating device), a halogen heater 36 (heat maintaining device), and a fixing roller 38 (fixing device) are disposed in this order in the fixing mechanism 14, from the upstream side to the downstream side in terms of the direction of rotation of the rotating drum 10.

The heating roller 34 pressurizes and heats the surface of the rotating drum 10 and the transfer surface of the recording paper 22 to which the image is transferred, at a prescribed pressure $P_1$, while being controlled to have a prescribed temperature $T_3$.

The halogen heater 36 heats the transfer surface of the recording paper 22 and the surface of the rotating drum 10 while being controlled to have a prescribed temperature $T_4$, in order to keep the transfer surface of the recording paper 22 which has been heated by the heating roller 34 and the surface of the rotating drum 10 (the outer circumferential surface) to a uniform temperature.

The fixing roller 38 pressurizes and heats the transfer surface of the recording paper 22 and the surface of the rotating drum 10, at a prescribed pressure $P_2$, while being controlled to have a prescribed temperature $T_5$.

Since the heating roller 34, the halogen heater 36 and the fixing roller 38 are provided as the fixing mechanism 14 in this way, decrease in the surface temperature of the recording paper 22 is suppressed during the fixing process, and it is thereby possible to fix the image reliably onto the recording paper 22.

The composition of the transfer roller 12, the fixing mechanism 14 and the periphery of same is as follows. Firstly, the recording paper 22 which has been conveyed by the recording paper supply roller 16 and is fixed to the surface of the rotating drum 10 is conveyed to a position opposing the temperature control roller 18 by the rotation of rotating drum 10, and is heated to a prescribed temperature required for a subsequent transfer step. In this case, the surface of the rotating drum 10 is also simultaneously heated to a prescribed temperature required in a subsequent transfer step, by means of the temperature control roller 18. The temperature control roller 18 is set to a higher temperature than the temperature of the surface of the rotating drum 10.

Thereupon, the recording paper 22 is conveyed to a position opposing the transfer roller 12 by the rotation of the rotating drum 10, and the image formed on the intermediate transfer body 13 is transferred in this transfer step. In the transfer step, the transfer roller 12 is set to a prescribed temperature on the basis of the surface temperature of the rotating drum 10 and the temperature of the recording paper 22.

Thereupon, the recording paper 22 is conveyed to a position opposing the fixing mechanism 14 by the rotation of the rotating drum 10, and the image which has been transferred to the recording paper 22 is fixed in this fixing step. In the fixing step, the fixing roller 38 is a pressurization roller which is set to a higher temperature than the surface temperature of the rotating drum 10 and the temperature of the recording paper 22. Furthermore, the heating roller 34 is a heating/pressurization roller which is set to a higher temperature than the surface temperature of the rotating drum 10 and the surface temperature of the recording paper 22, and applies a lower pressure to the recording medium than the fixing roller 38.

Moreover, the surface temperature of the rotating drum 10 which has been heated by the heating roller 34 is maintained by the halogen heater 36. The respective temperatures of the heating roller 34, the halogen heater 36 and the fixing roller 38 are determined respectively by thermocouples 30 to 32. The temperatures determined by the thermocouples 30 to 32 are input to a system controller 72, which is described below. On the basis of the input determination results, the system controller 72 sends instructions to a heater driver 78 so that heaters 89 provided in the heating roller 34, the halogen heater 36 and the fixing roller 38 are controlled to have prescribed temperatures.

Thereupon, the recording paper 22 is conveyed to a position corresponding to the chain conveyor 20 by the rotation of the rotating drum 10, and is output.

Figure 3:
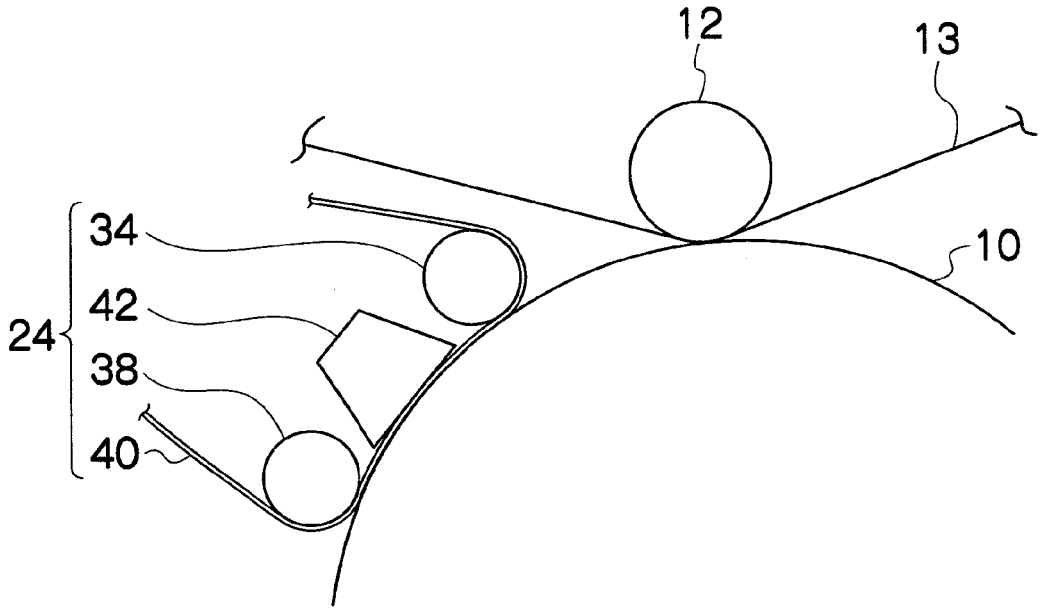
FIG. 3 is a diagram showing a modification example of the fixing mechanism.

The fixing mechanism 14 may be substituted with a fixing mechanism 24 having the composition shown in FIG. 3. As shown in FIG. 3, a difference of the fixing mechanism 24 with respect to the fixing mechanism 14 is that the fixing mechanism 24 comprises an endless belt 40 which is wrapped about a heating roller 34 and a fixing roller 38, and a heating member 42. The endless belt 40 slides over the surface of the rotating drum 10, or over the recording paper 22 if the recording paper 22 has been conveyed to the fixing mechanism 24. The heating member 42 is disposed on the side of the surface of the endless belt 40 reverse to the surface of the endless belt 40 that slides on the surface of the rotating drum 10 or the recording paper 22, as shown FIG. 3. The endless belt 40 is heated by this heating member 42.

Furthermore, the temperature control roller 18 may also serve as a cooling device, as well as a heating device. Consequently, if the temperature of the surface of the rotating drum 10 during transfer exceeds a target temperature due to the heating by the temperature control roller 18 (for example, if the temperature differential with respect to the target temperature of the surface of the rotating drum 10 during transfer and fixing is large), then either heating is not performed by the temperature control roller 18 or cooling is performed by the temperature control roller 18.

Optimum Temperature and Pressure Conditions in Respective Units

Figure 4:
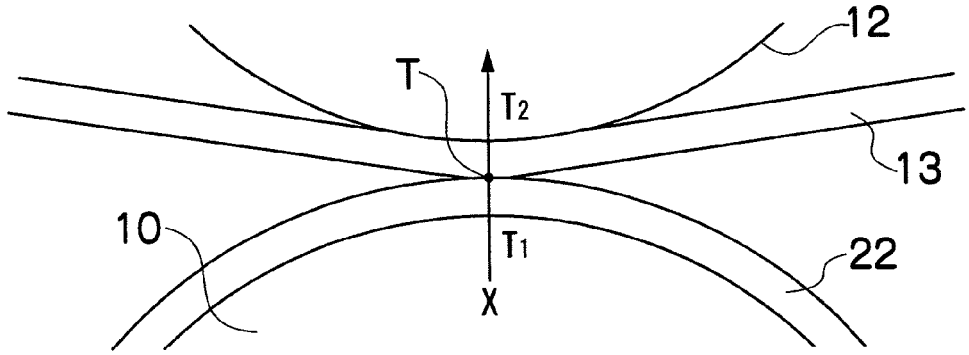
FIG. 4 is a diagram showing the relationship between the surface temperature of the rotating drum and the surface temperature of the transfer roller.

FIG. 4 is an enlarged diagram of a portion where an image formed on the intermediate transfer body 13 is transferred to the recording paper 22 which is fixed to the rotating drum 10, by the transfer roller 12. Furthermore, FIG. 5 is a diagram showing the temperature distribution at respective locations on the X axis shown in FIG. 4.

Figure 5:
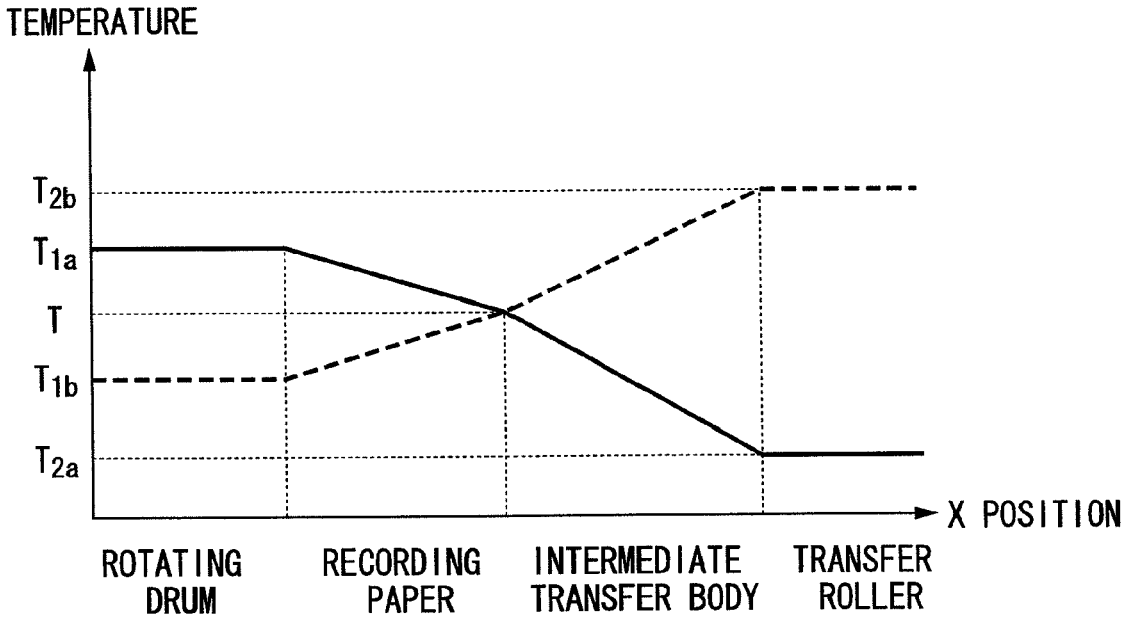
FIG. 5 is a diagram showing the temperature distribution at respective locations on the X axis shown in FIG. 4.

The interface temperature T which is the temperature of the portion where the recording paper 22 and the intermediate transfer body 13 make contact and the transfer is carried out as shown in FIG. 4, is controlled to a temperature between the surface temperature $T_1$ of the rotating drum 10 and the surface temperature $T_2$ of the transfer roller 12 as shown in FIG. 5. In order to do this, the interface temperature T of the recording paper 22 and the intermediate transfer body 13 is controlled by controlling the surface temperature $T_1$ of the rotating drum 10 and the surface temperature $T_2$ of the transfer roller 12.

Here, even if "the surface temperature $T_1=T_{1a}$ of the rotating drum 10" is greater than "the surface temperature $T_2=T_{2a}$ of the transfer roller 12" (i.e. $T_1=T_{1a}>T_2=T_{2a}$), and even if "the surface temperature $T_2=T_{2b}$ of the transfer roller 12" is not less than "the surface temperature $T_1=T_{1b}$ of the rotating drum 10" (i.e. $T_2=T_{2b}\geqq T_1=T_{1b}$), it is still possible to control the interface temperature T of the recording paper 22 and the intermediate transfer body 13 to a prescribed value between the surface temperature $T_1$ of the rotating drum 10 and the surface temperature $T_2$ of the transfer roller 12.

However, in the fixing mechanism 14 after transfer of the image by the transfer roller 12, it is necessary to make the temperature of the recording paper 22 higher than the temperature of the transfer roller 12. Consequently, if the surface temperature $T_1$ of the rotating drum 10 is previously set as high as possible and the temperature of the recording paper 22 is thereby raised, then it is possible rapidly to set the recording paper 22 to a prescribed temperature which is optimal for fixing in the fixing mechanism 14, and hence the time required for the fixing step can be shortened.

Furthermore, if the temperature of the intermediate transfer body 13 is too high immediately before transfer, then there is a possibility that the ink aggregate forming the image on the intermediate transfer body 13 may melt and the image may shrink. If the image shrinks in this fashion, then there is a possibility that the quality of the image might decline. Consequently, it is desirable that the surface temperature $T_2$ of the transfer roller 12 should be set as low as possible in such a manner that the temperature of the intermediate transfer body 13 does not become excessively high immediately before transfer.

Consequently, it is desirable to control the interface temperature T between the recording paper 22 and the intermediate transfer body 13, on the basis of the conditions that "the surface temperature $T_1=T_{1a}$ of the rotating drum 10" is greater than "the surface temperature $T_2=T_{2a}$ of the transfer roller 12" (i.e. $T_1=T_{1a}>T_2=T_{2a}$).

Figure 6:
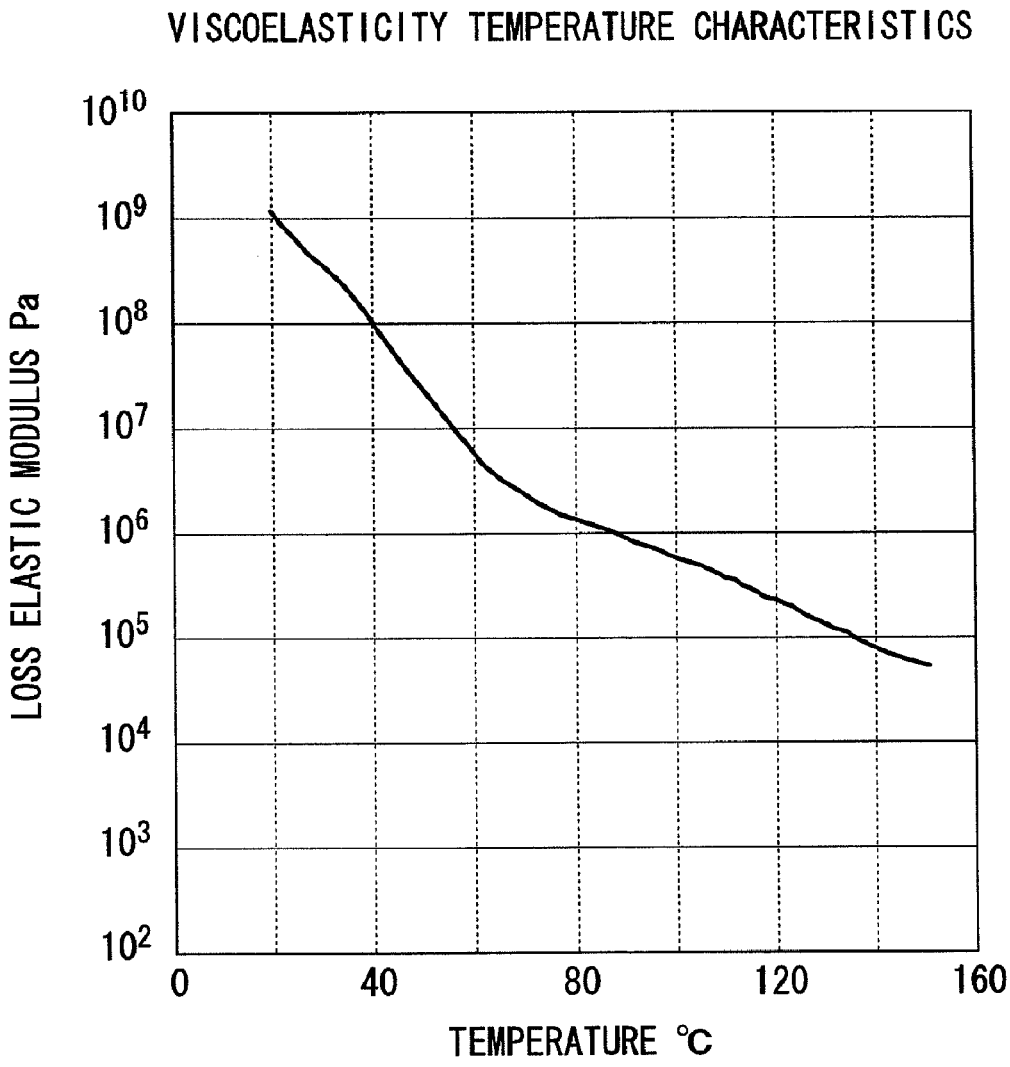
FIG. 6 is a diagram showing the viscoelasticity temperature characteristics of a binder latex.
Figure 7:
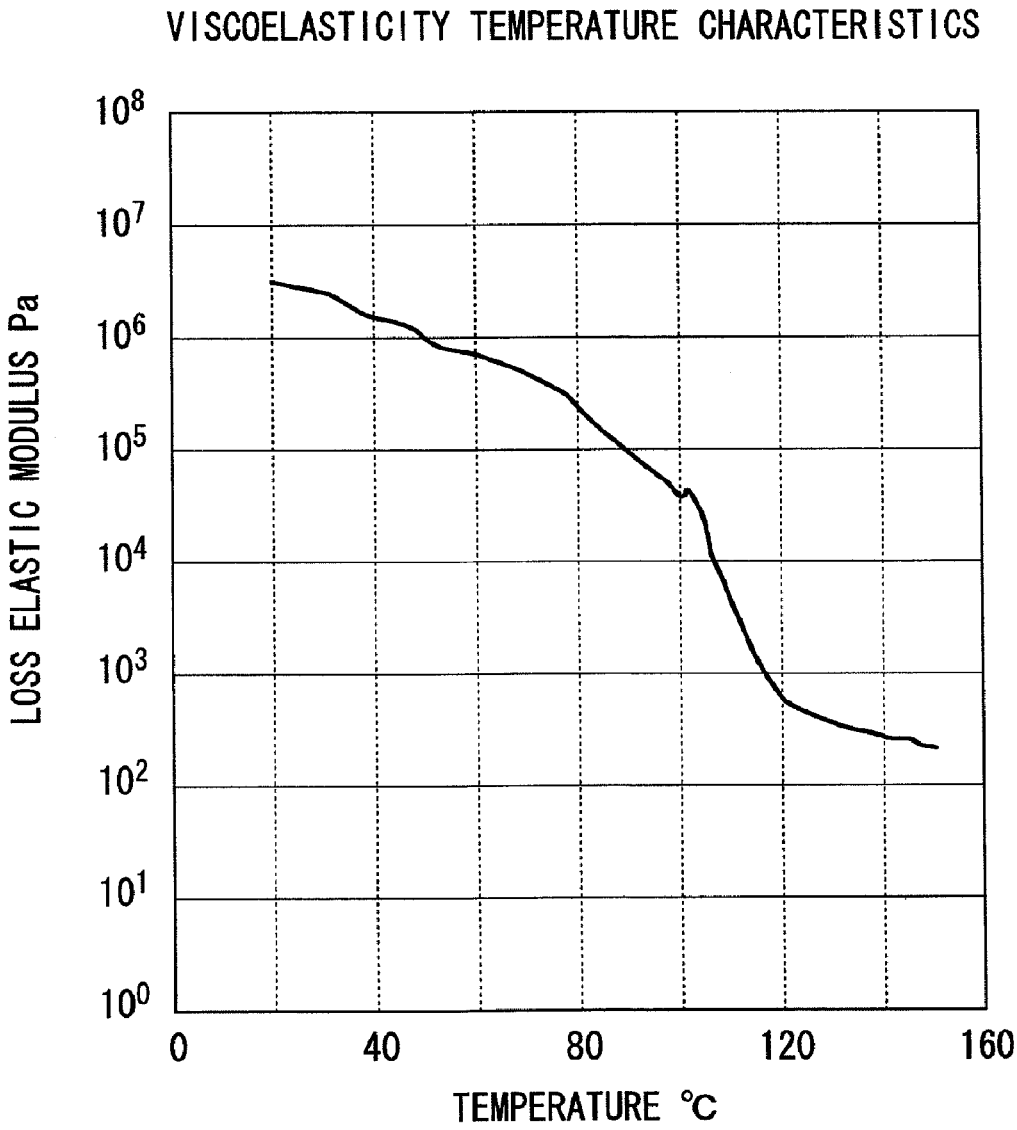
FIG. 7 is a diagram showing the viscoelasticity temperature characteristics of an undercoating latex.

Next, the optimal temperature and pressure conditions of the respective units are described. If an inkjet recording apparatus is considered as an image forming apparatus, then the image formed on the intermediate transfer body 13 is formed by generating a coloring material aggregate from an ink and a treatment liquid which has been deposited by a recording head, as described hereinafter. FIG. 6 is a diagram showing the viscoelasticity temperature characteristics of a binder latex which is contained in the ink used in the present embodiment, and FIG. 7 is a diagram showing the viscoelasticity temperature characteristics of an undercoating latex which is contained in the treatment liquid used in the present embodiment. As shown in FIG. 6 and FIG. 7, the binder latex and the undercoating latex have characteristics whereby the loss elastic modulus declines when the temperature increases.

Figure 8:
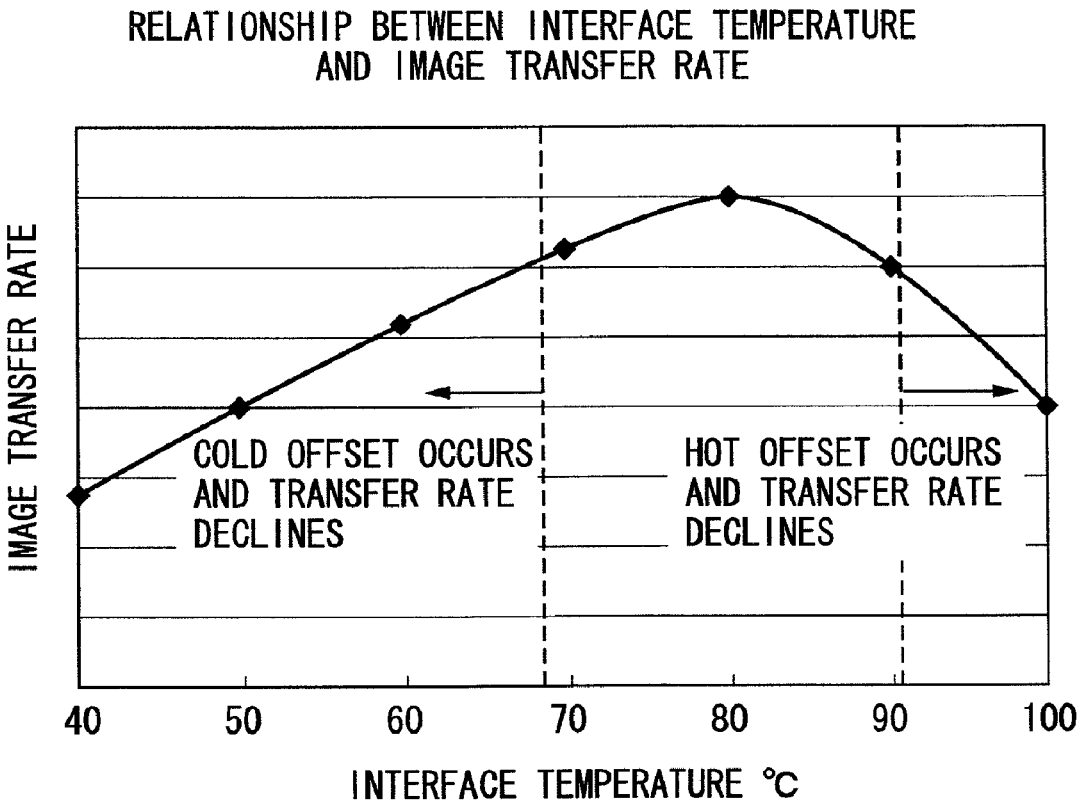
FIG. 8 is a diagram showing the relationship between the image transfer rate onto the recording paper and the interface temperature of the recording paper and the intermediate transfer body.

FIG. 8 is a diagram showing the relationship between the interface temperature T of the recording paper 22 and the intermediate transfer body 13 and the transfer rate of the image to the recording paper 22, in the case of the present embodiment which uses an ink and a treatment liquid respectively containing the binder latex and the undercoating latex which display the above-described viscoelasticity temperature characteristics.

In the present embodiment, if the interface temperature T of the recording paper 22 and the intermediate transfer body 13 is approximately 90° C. or higher, then the undercoating latex which forms the image on the intermediate transfer body 13 is heated to approximately 90° C. or higher, and therefore the loss elastic modulus of the undercoating latex is reduced to $10^5$ Pa or lower, as shown in FIG. 7. In this case, a hot offset is caused, and as shown in FIG. 8, the transfer rate of the image onto the recording paper 22 is lower than the required threshold value.

On the other hand, if the interface temperature T of the recording paper 22 and the intermediate transfer body 13 is approximately 68° C. or lower, then a cold offset is caused, and the transfer rate of the image onto the recording paper 22 is lower than the required threshold value.

Therefore, in the present embodiment, it is desirable that the interface temperature T of the recording paper 22 and the intermediate transfer body 13 is approximately 68° C. to approximately 90° C., in order to obtain an image transfer rate onto the recording paper 22 which is not less than the required threshold value. In particular, as shown in FIG. 8, the image transfer rate onto the recording paper 22 reaches a highest value when the interface temperature T of the recording paper 22 and the intermediate transfer body 13 is 80° C., and hence this is an optimum condition.

Investigation is carried out into the optimum conditions for the surface temperature of the rotating drum 10 and the surface temperature of the transfer roller 12, in order to control the interface temperature T of the recording paper 22 and the intermediate transfer body 13 to a temperature of 80° C., which is the optimum condition at which the image transfer rate onto the recording paper 22 assumes a highest value.

Figure 9:
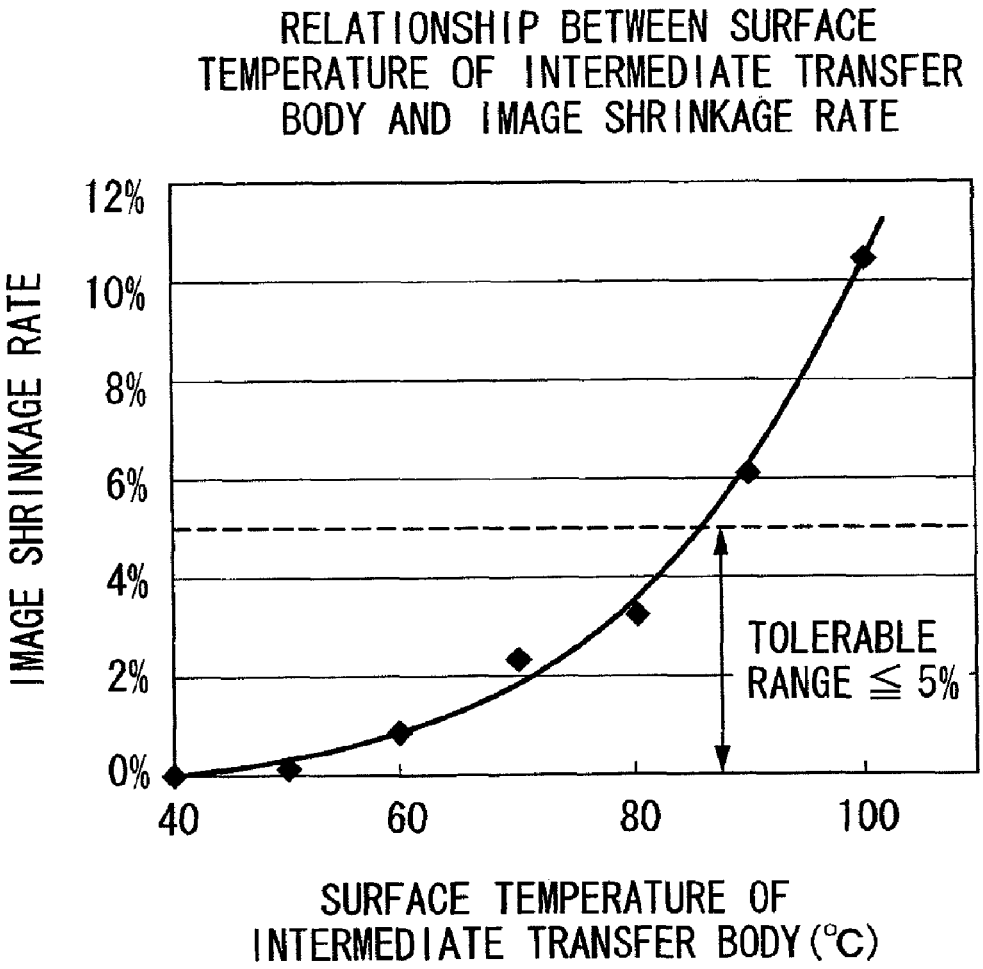
FIG. 9 is a diagram showing the relationship between the surface temperature of the intermediate transfer body and the image shrinkage rate of an image formed on the intermediate transfer body.

Firstly, as a precondition, the conditions indicated below are imposed for the surface temperature of the transfer roller 12, in relation to the shrinkage rate of the image formed on the intermediate transfer body 13. FIG. 9 is a diagram showing the relationship between the surface temperature of the intermediate transfer body 13 and the shrinkage rate of the image which is formed on the intermediate transfer body 13 in the present embodiment. As shown in FIG. 9, in the present embodiment, when the surface temperature of the intermediate transfer body 13 is not less than 85° C., the shrinkage rate of the image formed on the intermediate transfer body 13 is 5% or greater. Here, if the shrinkage rate of the image on the intermediate transfer body 13 before transfer to the recording paper 22 is 5% or greater, then there is a decline in the quality of the image transferred to the recording paper 22. Therefore, it is desirable to keep the surface temperature of the intermediate transfer body 13 to 85° C. or lower (preferable, lower than 85° C.). Consequently, it is desirable that the surface temperature of the transfer roller 12 which controls the surface temperature of the intermediate transfer body 13 should be kept to not higher than 85° C. (preferable, lower than 85° C.).

Furthermore, as described above, in the fixing mechanism 14, it is necessary to make the temperature of the recording paper 22 greater than the temperature of the transfer roller 12, and therefore by setting the surface temperature $T_1$ of the rotating drum 10 to as high a temperature as possible prior to transfer, it is possible to shorten the fixing process time.

From the above, as described previously, since the interface temperature T of the recording paper 22 and the intermediate transfer body 13 during transfer is controlled to 80° C. as an optimum condition for the image transfer rate to the recording paper 22, based on the condition that the surface temperature $T_1$ of the rotating drum 10 is greater than the surface temperature $T_2$ of the transfer roller 12 (i.e. $T_1>T_2$), then it is desirable to set the surface temperature $T_1$ of the rotating drum 10 to 90° C. and to set the surface temperature $T_2$ of the transfer roller 12 to 70° C.

Moreover, it is desirable that the surface temperature of the recording paper 22 should be set to 140° C. in the fixing mechanism 14. Consequently, it is desirable that the temperature of the heating roller 34, the thermostatic temperature setting (keeping temperature setting) of the halogen heater 36 and the temperature of the fixing roller 38 should all be set to 140° C. Furthermore, desirably, the nip pressure created by the heating roller 34 is set to 100 kPa, and the nip pressure created by the fixing roller 38 is set to 2 MPa.

To summarize the conditions described above, in the present embodiment, the optimal conditions for achieving the highest image transfer rate to the recording paper 22 are the conditions shown in FIG. 10. If the fixing mechanism 14 is substituted with the fixing mechanism 24 having the composition such as that shown in FIG. 3, then the temperature $T_6$ of the heating member 42 is set to 140° C.

Figure 11:
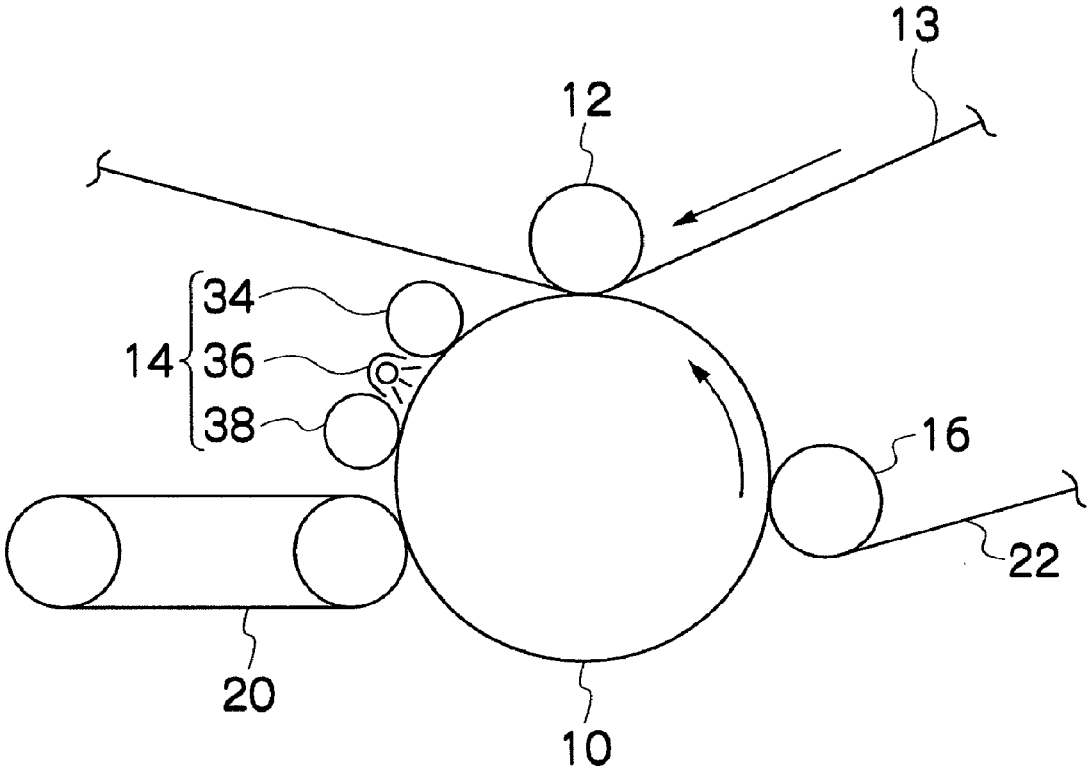
FIG. 11 is a diagram showing a further modification example.

When the transfer temperature of the transfer roller 12 is low or when the thermal capacity of the recording paper 22 is low, then as shown in FIG. 11, even if there is no temperature control roller 18, it is possible to achieve a desired transfer temperature by means of the transfer roller 12 and the fixing mechanism 14.

Figure 12:
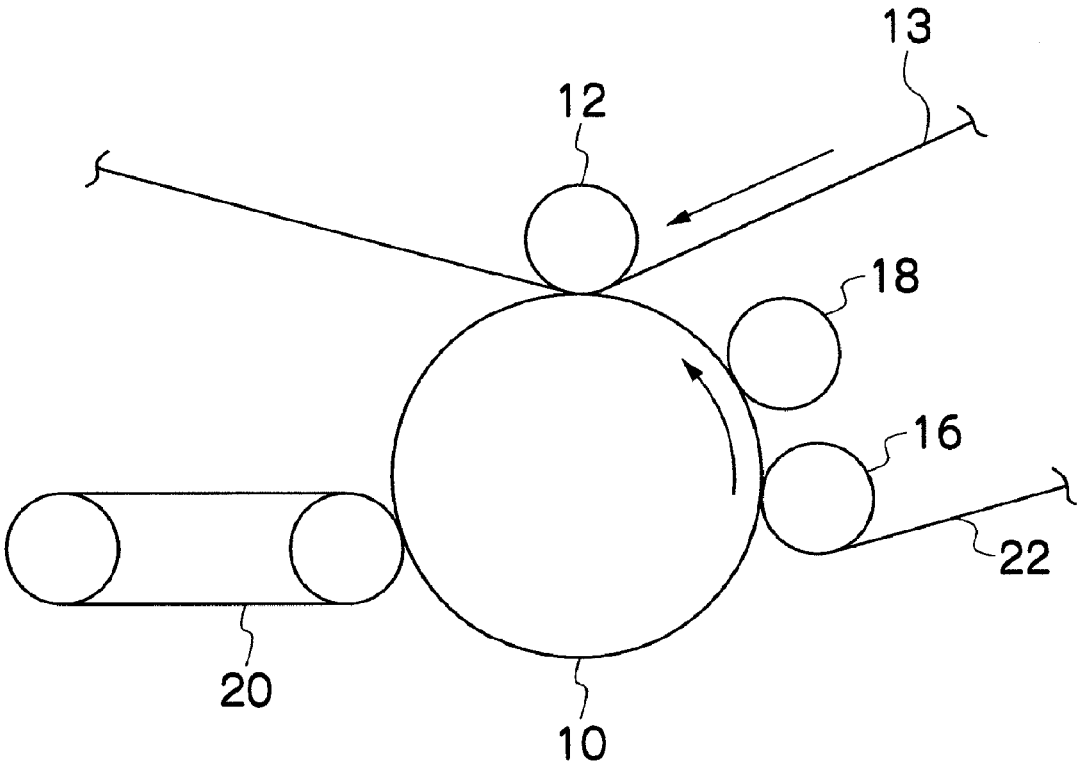
FIG. 12 is a diagram showing a further modification example.

Furthermore, if it is possible to obtain the required image strength and luster by means of the transfer roller 12 alone, then there is no need to provide the fixing mechanism 14, as shown in FIG. 12.

Composition of Inkjet Recording Apparatus

Figure 13:
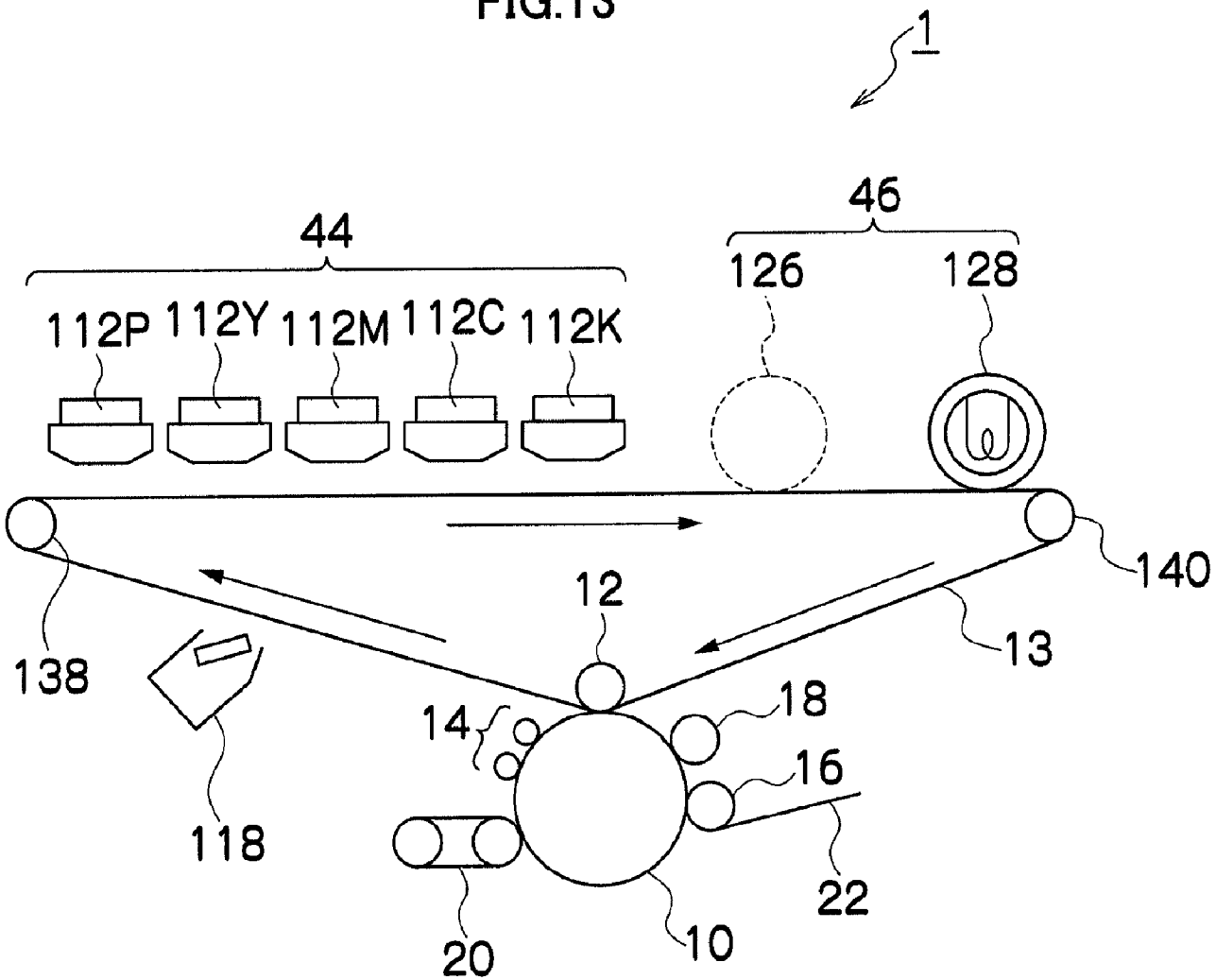
FIG. 13 is a general schematic drawing of an inkjet recording apparatus which forms one embodiment of an image forming apparatus relating to an embodiment of the present invention.

FIG. 13 is a general schematic drawing of an image processing apparatus which forms one embodiment of an image forming apparatus relating to an embodiment of the present invention. The inkjet recording apparatus 1 comprises: the transfer roller 12; the fixing mechanism 14; the peripheral composition of same described above (the rotating drum 10, the recording paper supply roller 16, the temperature control roller 18 and the chain conveyor 20); the print unit 44; the solvent removal and drying unit 46; and the like.

In the print unit 44, as shown in FIG. 13, a plurality of inkjet heads (hereinafter, simply called "heads") 112P, 112Y, 112M, 112C and 112K are provided to correspond to a treatment liquid (P) which serves as a first liquid, and respective inks of the colors of yellow (Y), magenta (M), cyan (C) and black (K) which serve as a second liquid. In the present embodiment the treatment liquid is deposited by means of a head, but apart from this, it is also possible to apply the treatment liquid by means of an application roller (not shown), or the like.

Moreover, it is also possible to provide a treatment liquid thickness control unit which controls the thickness of the treatment liquid to a high degree of accuracy after the treatment liquid has been deposited, in order to achieve a uniform thin layer of treatment liquid. The thickness of the treatment liquid has a significant effect on the spreading of the ink. In particular, possible methods for setting the thickness of the treatment liquid to a thin layer of 1 μm or less include, for example: after the treatment liquid is applied to large thickness, scraping by means of a hot blade or drying the treatment liquid. Desirably, a blade unit or a treatment liquid drying unit is provided as a unit for controlling the thickness of the treatment liquid.

The intermediate transfer body 13 is endless and is suspended about rollers (138, 140) and a transfer and pressurization roller 12. Possible materials for the intermediate transfer body 13 include, for example: polyurethane resin, polyester resin, polystyrene resin, polyolefin resin, polybutadiene resin, polyamide resin, polyvinyl chloride resin, polyethylene resin, fluorine resin, polyimide resin, silicon resin, and commonly known other materials which are used in general transfer bodies of such an endless belt type.

It is also possible to provide a resistance adjusting layer containing a dispersion of a suitable conductive material, on the surface of an endless belt which is made from one of the materials given above, and in this case also, it is appropriate to adopt the composition employed in a general intermediate transfer body. Furthermore, an endless belt made of electroformed nickel which is imparted with separating properties by providing a silicone or fluorine thin film on the surface thereof is also appropriate for use as the intermediate transfer body 13. In the present embodiment, an endless belt shape is employed, but embodiments of the present invention are not limited to this, and it is also possible to use a drum-shaped body, for example.

The solvent removal and drying unit 46 comprises: a solvent removal unit 126 which is constituted by an absorbing roller, a recovery unit, and the like; and a solvent drying unit 128. The solvent removal method used in the solvent removal unit 126 may be a method which abuts a porous material in the form of a roller against the intermediate transfer body 13, a method which removes the excess solvent from the intermediate transfer body 13 by means of an air knife, or a method which evaporates and removes the solvent by heating, or the like. The present embodiment employs a method which abuts a ceramic porous body (a material formed by sintering alumina particles) against the intermediate transfer body 13. Due to the presence of a solvent removal device of this kind, even if a large amount of treatment liquid is deposited on the intermediate transfer body 13, the solvent is removed by the solvent removal unit 126 and therefore the dispersion medium is not transferred in large amounts onto the recording paper 22. Consequently, problems which are characteristic of water-based solvents, such as curling or cockling of the recording paper 22, do not occur.

Furthermore, a transfer body cleaning unit 118 is provided to clean the intermediate transfer body 13.

Figure 14A:
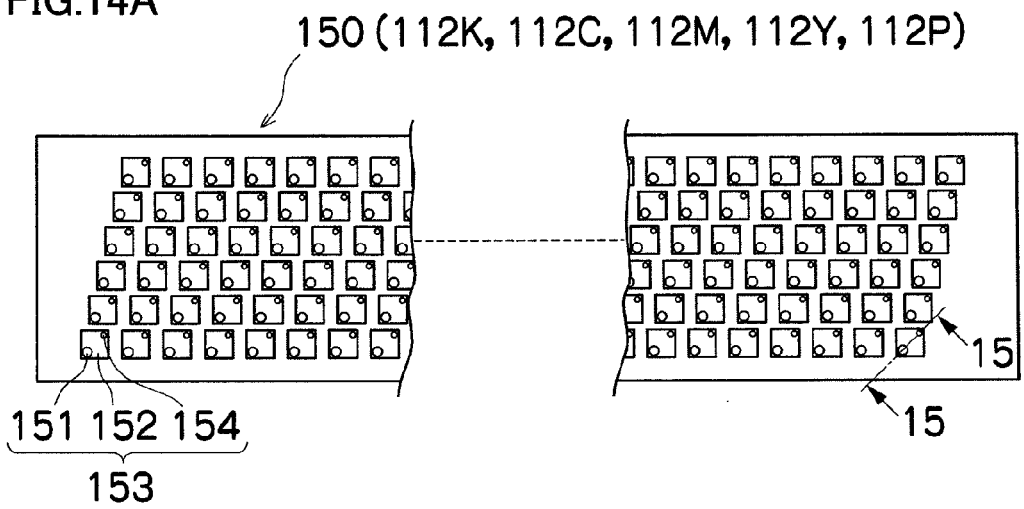
FIG. 14A is a plan view perspective diagram showing an example of the structure of a head.

The heads 112P, 112Y, 112M, 112C and 112K of the print unit 44 are full line type heads which have a length corresponding to the maximum width of the intermediate transfer body 13, each head comprising a plurality of nozzles for ejecting ink which are provided in a nozzle surface (see FIG. 14A).

The heads 112P, 112Y, 112M, 112C and 112K are provided in the order, treatment liquid (P), yellow (Y), magenta (M), cyan (C) and black (K), from the upstream side in terms of the direction of conveyance of the intermediate transfer body 13, and these respective heads 112P, 112Y, 112M, 112C and 112K are fixed so as to extend following a direction which is substantially perpendicular to the direction of conveyance of the intermediate transfer body 13.

Firstly, a treatment liquid containing an aggregating agent is ejected by the head 112P while conveying the intermediate transfer body 13, and then ink liquids containing coloring materials of different colors are ejected respectively from the heads 112Y, 112M, 112C and 112K, thereby forming a mixed liquid of the treatment liquid and ink liquid on the intermediate transfer body 13. A coloring material aggregate created by aggregation of the coloring material by the aggregating agent is generated in the mixed liquid, and a color image is formed by the aggregated coloring material on the intermediate transfer body 13. Subsequently, the liquid component of the mixed liquid is removed by the solvent removal unit 126 and the aggregate of the coloring material on the intermediate transfer body 13 is transferred to the recording paper 22, thereby forming a color image on the recording paper 22.

In this way, by adopting a composition which comprises, for each color, a full line type head 112Y, 112M, 112C and 112K having nozzle rows covering the full width of the intermediate transfer body 13 which is to form an image ultimately by transfer, it is possible to record an image over the whole surface of the recording paper 22 by performing just one operation of moving the intermediate transfer body 13 and the print unit 44 relatively in the direction of conveyance of the intermediate transfer body 13 (in other words, by just one sub-scanning action). Higher-speed printing is thereby made possible and productivity can be improved in comparison with a shuttle type head configuration in which a recording head moves back and forth reciprocally in a direction which is perpendicular to the conveyance direction of the intermediate transfer body 13.

Although the configuration with the KCMY four standard colors is described in the present embodiment, combinations of the ink colors and the number of colors are not limited to those. Light inks, dark inks and special color inks can be added as required. For example, a configuration is possible in which inkjet heads for ejecting light-colored inks such as light cyan and light magenta are added. Furthermore, there are no particular restrictions of the sequence in which the heads of respective colors are arranged. Furthermore, it is also possible to add heads ejecting a colorless transparent tone, and a white color which is used for the bottom layer on a transparent substrate.

Moreover, it is also possible to apply heat during the transfer process, in order to improve the transfer rate and to control the luster of the image surface.

Structure of Head

Next, the structure of the heads will be described. The respective heads 112P, 112Y, 112M, 112C and 112K have the same structure, and a reference numeral 150 is hereinafter designated to any of the heads.

Figure 14B:
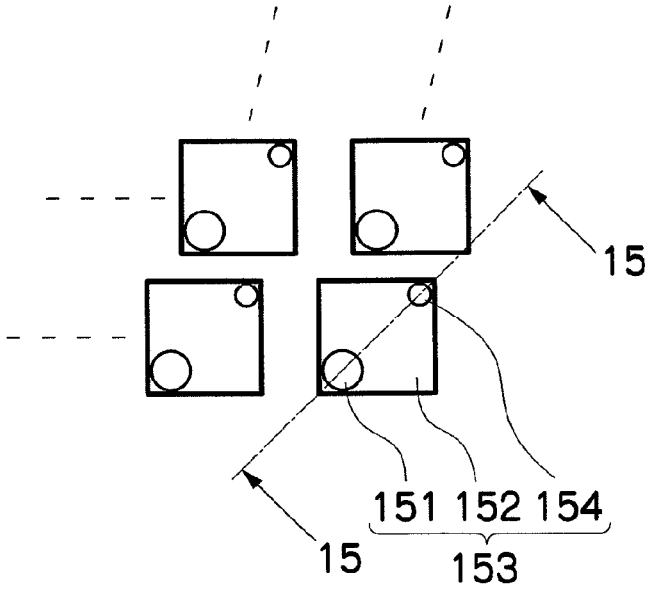
FIG. 14B is an enlarged diagram showing one portion of the head.
Figure 14C:
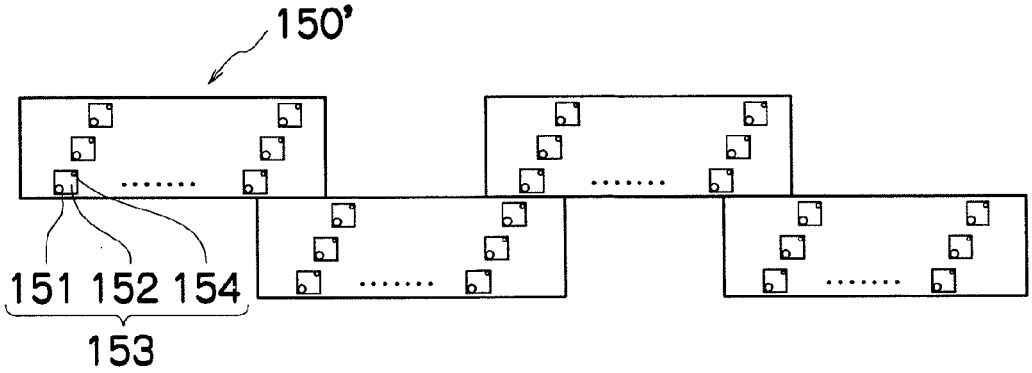
FIG. 14C is a plan view perspective diagram showing a further example of the structure of a head.
Figure 15:
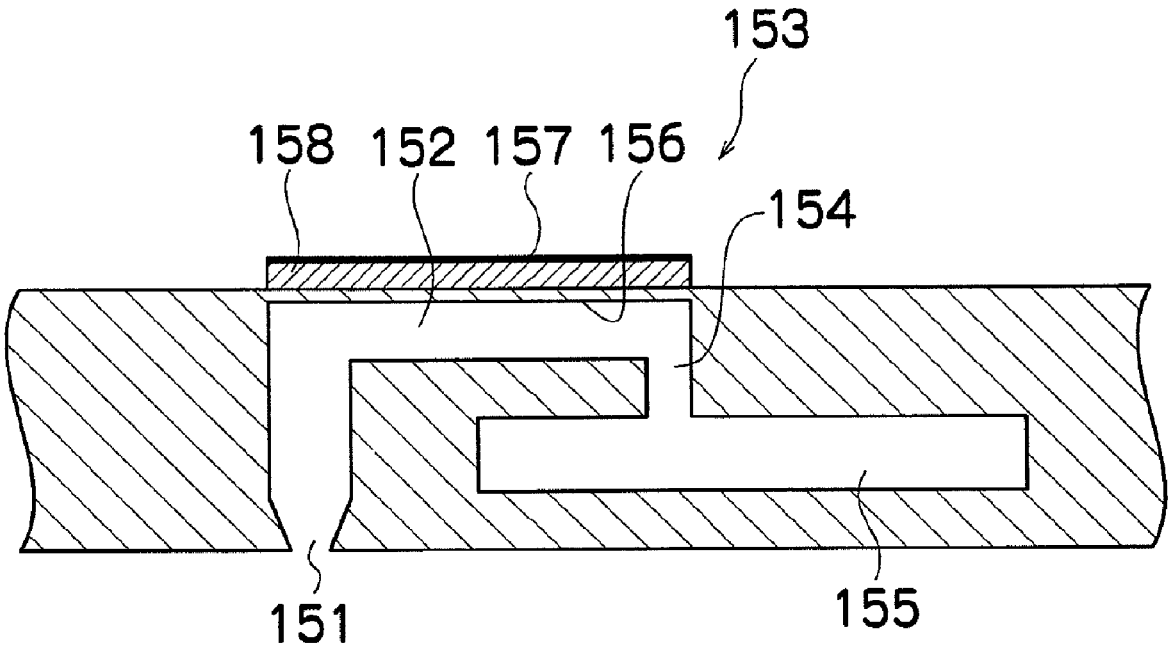
FIG. 15 is a cross-sectional diagram showing the composition of one liquid droplet ejection element (an ink chamber unit corresponding to one nozzle), along line 15-15 in FIGS. 14A and 14B.

FIG. 14A is a perspective plan view showing an example of the configuration of the head 150, FIG. 14B is an enlarged view of a portion thereof, FIG. 14C is a perspective plan view showing another example of the configuration of the head 150, and FIG. 15 is a cross-sectional view taken along line 15-15 in FIGS. 14A and 14B, showing the composition of a droplet ejection element (an ink chamber unit for one nozzle 151).

The nozzle pitch in the head 150 should be minimized in order to maximize the density of the dots printed on the surface of the recording paper 22. As shown in FIGS. 14A and 14B, the head 150 according to the present embodiment has a structure in which a plurality of ink chamber units (droplet ejection elements) 153, each comprising a nozzle 151 forming an ink ejection port, a pressure chamber 152 corresponding to the nozzle 151, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the maximum image output size in a direction substantially perpendicular to the conveyance direction of the intermediate transfer body 13 is not limited to the example described above. For example, instead of the configuration in FIG. 14A, as shown in FIG. 14C, a line head having nozzle rows of a length corresponding to the entire width of the recording paper 22 can be formed by arranging and combining, in a staggered matrix, short head modules 150' having a plurality of nozzles 151 arrayed in a two-dimensional fashion.

As shown in FIGS. 14A and 14B, the planar shape of a pressure chamber 152 provided corresponding to each nozzle 151 is substantially a square shape, and an outlet port to the nozzle 151 is provided at one of the ends of a diagonal line of the planar shape, while an inlet port (supply port) 154 for supplying ink is provided at the other end thereof. The shape of the pressure chambers 152 is not limited to that of the present example and various modes are possible in which the planar shape is a quadrilateral shape (diamond shape, rectangular shape, or the like), a pentagonal shape, a hexagonal shape, or other polygonal shape, or a circular shape, elliptical shape, or the like.

As shown in FIG. 15, each pressure chamber 152 is connected to a common flow channel 155 through the supply port 154. The common flow channel 155 is connected to an ink tank (not shown), which is a base tank that supplies ink, and the ink supplied from the ink tank is delivered through the common flow channel 155 to the pressure chambers 152.

Actuators 158 each provided with an individual electrode 157 are bonded to a pressure plate (a diaphragm that also serves as a common electrode) 156 which forms the surface of one portion (in FIG. 15, the ceiling) of the pressure chambers 152. When a drive voltage is applied to the individual electrode 157 and the common electrode, the actuator 158 deforms, thereby changing the volume of the pressure chamber 152. This causes a pressure change which results in ink being ejected from the nozzle 151. For each actuator 158, it is possible to adopt a piezoelectric element using a piezoelectric body, such as lead zirconate titanate, barium titanate, or the like. When the displacement of the actuator 158 returns to its original position after ejecting ink, the pressure chamber 152 is replenished with new ink from the common flow channel 155, via the supply port 154.

Figure 16:
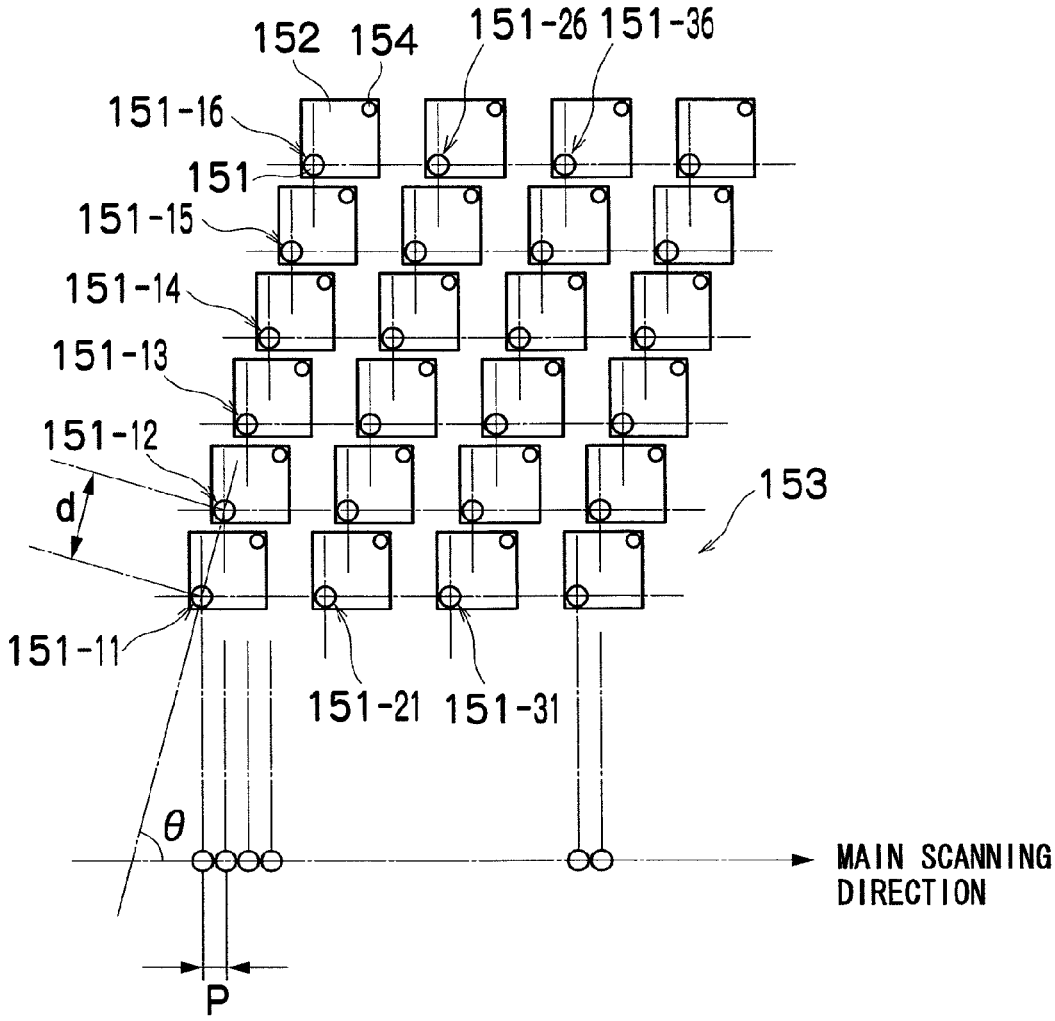
FIG. 16 is a diagram showing the arrangement pattern of ink chamber units.

As shown in FIG. 16, the high-density nozzle head according to the present embodiment is achieved by arranging a plurality of ink chamber units 153 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 153 are arranged at a uniform pitch d in line with a direction forming an angle of θ with respect to the main scanning direction, the pitch P of the nozzles projected so as to align in the main scanning direction is $d \times \cos\theta$, and hence the nozzles 151 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the intermediate transfer body (the direction perpendicular to the conveyance direction of the intermediate transfer body) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 151 arranged in a matrix such as that shown in FIG. 16 are driven, the main scanning according to the above-described (3) is preferred. More specifically, the nozzles 151-11, 151-12, 151-13, 151-14, 151-15 and 151-16 are treated as a block (additionally; the nozzles 151-21, . . . , 151-26 are treated as another block; the nozzles 151-31, . . . , 151-36 are treated as another block; . . . ); and one line is printed in the width direction of the intermediate transfer body 13 by sequentially driving the nozzles 151-11, 151-12, . . . , 151-16 in accordance with the conveyance velocity of intermediate transfer body 13.

On the other hand, "sub-scanning" is defined as to repeatedly perform printing of one line (a line formed of a row of dots, or a line formed of a plurality of rows of dots) formed by the main scanning described above, while moving the above-described full-line head and the intermediate transfer body 13 relatively to each other.

The direction indicated by one line (or the lengthwise direction of a band-shaped region) recorded by main scanning as described above is called the "main scanning direction", and the direction in which sub-scanning is performed, is called the "sub-scanning direction". In other words, in the present embodiment, the conveyance direction of the intermediate transfer body 13 is called the sub-scanning direction and the direction perpendicular to same is called the main scanning direction.

In implementing the present invention, the arrangement of the nozzles is not limited to that of the example shown. Moreover, a method is employed in the present embodiment where an ink droplet is ejected by means of the deformation of an actuator 158, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Description of Control System

Figure 17:
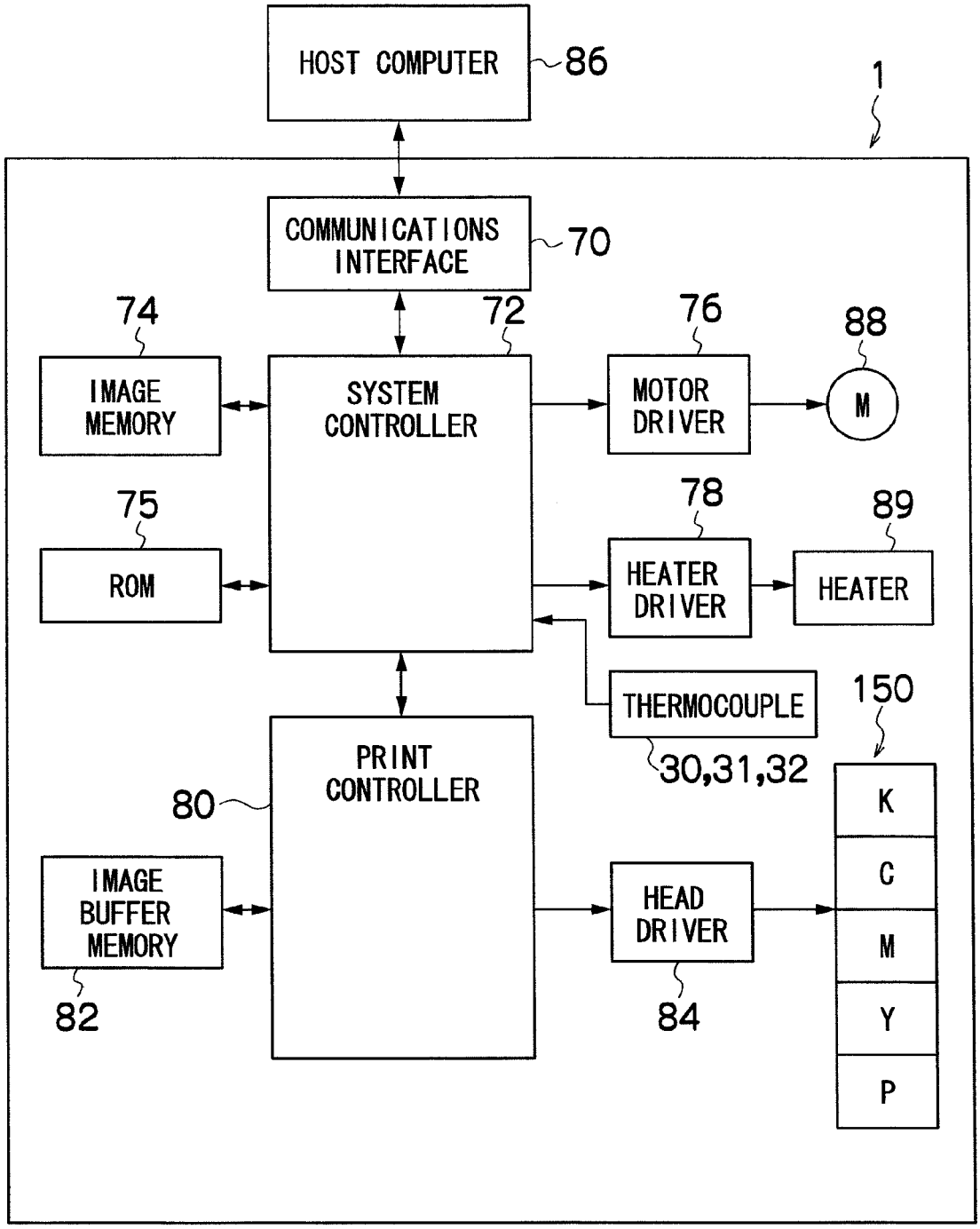
FIG. 17 is a block diagram showing a system composition of the inkjet recording apparatus.

FIG. 17 is a block diagram showing the system configuration of the inkjet recording apparatus 1. As shown in FIG. 17, the inkjet recording apparatus 1 comprises a communications interface 70, a system controller 72, an image memory 74, a ROM 75, a motor driver 76, a heater driver 78, a print controller 80, an image buffer memory 82, a head driver 84, and the like.

The communications interface 70 is an interface unit (image input unit) which functions as an image input device for receiving image data transmitted from a host computer 86. A serial interface such as USB (Universal Serial Bus), IEEE1394, Ethernet (registered trademark), wireless network, or a parallel interface such as a Centronics interface may be used as the communications interface 70. A buffer memory (not shown) may be mounted in this portion in order to increase the communication speed.

The image data sent from the host computer 86 is received by the inkjet recording apparatus 1 through the communications interface 70, and is temporarily stored in the image memory 74. The image memory 74 is a storage device for storing images inputted through the communications interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 1 as well as a calculation device for performing various calculations, in accordance with prescribed programs. More specifically, the system controller 72 controls the various sections, such as the communications interface 70, image memory 74, motor driver 76, heater driver 78, and the like, as well as controlling communications with the host computer 86 and writing and reading to and from the image memory 74 and ROM 75, and it also generates control signals for controlling the motors 88 of the conveyance system and heaters 89.

Furthermore, the system controller 72 functions as a control device which controls the surface temperature $T_1$ of the rotating drum 10 and the surface temperature $T_2$ of the transfer roller 12 during transfer, on the basis of the viscoelasticity characteristics of the latex contained in the ink and treatment liquid which are deposited onto the intermediate transfer body 13 by the heads 112P, 112Y, 112M, 112C and 112K, so as to control the interface temperature T of the recording paper 22 and the intermediate transfer body 13.

Programs executed by the CPU of the system controller 72 and various types of data (including data for a test pattern for measuring landing position error) which are required for control procedures are stored in the ROM 75. The ROM 75 may be a non-rewritable storage device, or it may be a rewritable storage device, such as an EEPROM.

The image memory 74 is used as a temporary storage region for the image data, and it is also used as a program development region and a calculation work region for the CPU.

The motor driver (drive circuit) 76 drives the motors 88 of the conveyance system in accordance with commands from the system controller 72. The heater driver (drive circuit) 78 drives the heater 89 of the post-drying unit (not shown) and the like in accordance with commands from the system controller 72. The heaters 89 further include: a heater for the temperature control roller 18, a heater for the transfer roller 12 (heater for controlling the surface temperature $T_2$), a heater for the heating roller 34, the halogen heater 36, and a heater for the fixing roller 38, and the like.

The print controller 80 is a control unit which functions as a signal processing device for performing various treatment processes, corrections, and the like, in accordance with the control implemented by the system controller 72, in order to generate a signal for controlling droplet ejection from the image data (multiple-value input image data) in the image memory 74, as well as functioning as a drive control device which controls the ejection driving of the head 150 by supplying the ink ejection data thus generated to the head driver 84.

The print controller 80 is provided with the image buffer memory 82; and image data, parameters, and other data are temporarily stored in the image buffer memory 82 when image data is processed in the print controller 80. The aspect shown in FIG. 17 is one in which the image buffer memory 82 accompanies the print controller 80; however, the image memory 74 may also serve as the image buffer memory 82. Also possible is an aspect in which the print controller 80 and the system controller 72 are integrated to form a single processor.

To give a general description of the sequence of processing from image input to print output, image data to be printed (original image data) is input from an external source via a communications interface 70, and is accumulated in the image memory 74. At this stage, multiple-value ROB image data is stored in the image memory 74, for example.

In other words, the print controller 80 performs processing for converting the input RGB image data into dot data for the four colors of K, C, M and Y The dot data generated by the print controller 80 in this way is stored in the image buffer memory 82. This dot data of the respective colors is converted into CMYK droplet ejection data for ejecting inks from the nozzles of the heads 150, thereby establishing the ink ejection data to be printed.

The head driver 84 outputs drive signals for driving the actuators 158 corresponding to the nozzles 151 of the heads 150 in accordance with the print contents, on the basis of the ink ejection data and the drive waveform signals supplied by the print controller 80. A feedback control system for maintaining constant drive conditions for the heads may be included in the head driver 84.

By supplying the drive signals output by the head driver 84 to the heads 150 in this way, ink is ejected from the corresponding nozzles 151. By controlling ink ejection from the print heads 150 in synchronization with the conveyance speed of the recording paper 22, an image is formed on the recording paper 22.

As described above, the ejection volume and the ejection timing of the ink droplets from the respective nozzles are controlled via the head driver 84, on the basis of the ink ejection data and the drive signal waveform generated by implementing required signal processing in the print controller 80. By this means, desired dot sizes and dot positions can be achieved.

Image forming apparatuses and image forming methods according to embodiments of the present invention have been described in detail above, but the present invention is not limited to the aforementioned examples, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

an intermediate transfer body which carries an image;

a transfer mechanism which transfers the image carried on the intermediate transfer body, onto a transfer surface of a recording medium fixed to a surface of a rotating body; and a fixing mechanism which is disposed so as to oppose the surface of the rotating body to a downstream side of the transfer mechanism in terms of a direction of rotation of the rotating body, and which fixes the image that has been transferred to the transfer surface of the recording medium, onto the recording medium, wherein the recording medium is conveyed from the transfer mechanism to the fixing mechanism in a state where it is fixed to the surface of the rotating body.

2. The image forming apparatus as defined in claim 1, wherein the fixing mechanism has:

a heating device which heats the transfer surface of the recording medium onto which the image has been transferred;

a heat maintaining device which maintains a heat of the transfer surface of the recording medium which has been heated by the heating device; and a fixing device which is disposed to a downstream side of the heating device in terms of the direction of rotation of the rotating body, and which fixes the image that has been transferred to the transfer surface of the recording medium.

3. The image forming apparatus as defined in claim 2, wherein the fixing device has a pressurization roller which is set to a higher temperature than a surface temperature of the rotating body.

4. The image forming apparatus as defined in claim 3, wherein the heating device has a pressurization roller which is set to a higher temperature than the surface temperature of the rotating body, and which applies a lower pressure to the recording medium than the fixing device.

5. The image forming apparatus as defined in claim 2, wherein the heat maintaining device is a radiant heating device.

6. The image forming apparatus as defined in claim 2, wherein the heat maintaining device has an endless belt which is wrapped about the heating device and the fixing device, and which slides over the surface of the rotating body while being conveyed.

7. The image forming apparatus as defined in claim 6, wherein the heat maintaining device has a heating member which contacts with a surface of the endless belt on an opposite side to a surface of the endless belt which slides over the surface of the rotating body.

8. The image forming apparatus as defined in claim 1, further comprising a temperature control mechanism which is disposed to an upstream side of the transfer mechanism in terms of the direction of rotation of the rotating body, and which controls a temperature of the recording medium.

9. The image forming apparatus as defined in claim 8, wherein the temperature control mechanism controls a surface temperature of the rotating body.

10. The image forming apparatus as defined in claim 8, wherein the temperature control mechanism has a pressurization roller which is set to a higher temperature than a surface temperature of the rotating body.

11. The image forming apparatus as defined in claim 1, wherein the transfer mechanism has a pressurization roller which is disposed so as to oppose the surface of the rotating body, and which is set to a lower temperature than a surface temperature of the rotating body.

12. The image forming apparatus as defined in claim 1, further comprising:

a liquid deposition device which deposits ink and treatment liquid to form the image carried on the intermediate transfer body; and a control device which controls an interface temperature which is a temperature of a portion where the recording medium and the intermediate transfer body make mutual contact during transfer in the transfer mechanism, according to viscoelasticity characteristics of a latex contained in the ink and the treatment liquid which are deposited onto the intermediate transfer body by the liquid deposition device.

13. An image forming method, comprising:

a transfer step of transferring an image carried on an intermediate transfer body, to a recording medium fixed to a surface of a rotating body; and a fixing step of fixing the image transferred to the recording medium in the transfer step, in a state where the recording medium is fixed to the surface of the rotating body, wherein the recording medium is in a state where it is fixed to the surface of the rotating body from the transfer step to the fixing step.

* * * * *